US011331776B2

(12) United States Patent
Su

(10) Patent No.: US 11,331,776 B2
(45) Date of Patent: May 17, 2022

(54) FLEX-HEAD TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 199 days.

(21) Appl. No.: 16/731,485

(22) Filed: Dec. 31, 2019

(65) Prior Publication Data

US 2020/0306937 A1 Oct. 1, 2020

(30) Foreign Application Priority Data

Mar. 29, 2019 (TW) ..... 108111394

(51) Int. Cl.

| | |
|---|---|
| ***B25B 23/00*** | (2006.01) |
| ***B25G 1/06*** | (2006.01) |
| ***B25B 23/16*** | (2006.01) |
| ***B25B 13/46*** | (2006.01) |

(52) U.S. Cl.

CPC ..... *B25B 23/0028* (2013.01); *B25B 23/16* (2013.01); *B25G 1/063* (2013.01); *B25B 13/462* (2013.01)

(58) Field of Classification Search

CPC ... B25B 23/0028; B25B 23/16; B25B 13/462; B25G 1/063

USPC ..... 81/60–63.2

See application file for complete search history.

(56) References Cited

U.S. PATENT DOCUMENTS

| | | | | |
|---|---|---|---|---|
| 5,199,335 | A * | 4/1993 | Arnold | B25G 1/063 81/177.7 |
| 6,848,344 | B2 * | 2/2005 | Rocco | B25G 1/063 403/91 |
| 7,197,965 | B1 * | 4/2007 | Anderson | B25B 13/481 81/177.9 |
| 7,591,208 | B2 * | 9/2009 | Cole | B25G 1/025 403/103 |
| 2016/0271767 | A1 | 9/2016 | Su | |

FOREIGN PATENT DOCUMENTS

| | | | |
|---|---|---|---|
| TW | M534074 | U | 12/2016 |
| TW | I568550 | B | 2/2017 |
| TW | 201741085 | A | 12/2017 |
| TW | 201806714 | A | 3/2018 |
| WO | WO2018126341 | A1 | 7/2018 |

* cited by examiner

*Primary Examiner* — Hadi Shakeri

(74) *Attorney, Agent, or Firm* — Alan D. Kamrath; Karin L. Williams; Mayer & Williams PC

(57) ABSTRACT

A flex-head tool includes a first portion pivotally coupled to a second portion. A pivot mechanism is engaged with the first and the second portions. The pivot mechanism is movable between a first position in which the first portion is fixedly positioned with respect to the second portion, and a second position in which the first portion is pivotal with relative to the second portion. The pivot mechanism includes a toothed first engaging portion engageable with teeth of pivot holes of the first and the second portions simultaneously and not simultaneously selectively and a second engaging portion connected with a pivot hole and in surface-to-surface contact.

17 Claims, 11 Drawing Sheets

FLEX-HEAD TOOL

BACKGROUND OF THE INVENTION

1. Field of the Invention

The present invention relates to a tool and, particularly, to a flex-head tool.

2. Description of the Related Art

TW Patent No. 1568550 shows a pivot head type hand tool. The hand tool includes a grip, a first through hole defined in the grip, a first positioning portion on the inner periphery of the first through hole, and a tool head pivotally connected to the grip. A tool socket can engage with the tool head. The tool head has a pivot portion, a third through hole defined in the pivot portion, and a third positioning portion on the inner periphery of the third through hole. The third through hole is in communication with the first through hole. A positioning assembly includes a first ratchet wheel slidably engaged in the first and third through holes. The outer periphery of the first ratchet wheel has a first engaging portion extending circumferentially. When the pivot portion of the tool head is restrained from pivoting with respect to the grip, the first engaging portion engages with the first and the third positioning portions. When the pivot portion of the tool head is pivoted with respect to the grip, the first engaging portion engages with the third positioning portion.

Further, the hand tool includes a second ratchet wheel and a biasing spring including one end against the second ratchet wheel and another end against the first ratchet wheel. Thus, the first and the second ratchet wheels are biasingly supported by the biasing spring. The outer periphery of the second ratchet wheel has a second engaging portion extending circumferentially. A first stop ring stops the first ratchet wheel and a second stop ring stops the second ratchet wheel respectively. The first and the second ratchet wheels are pressed simultaneously against the biasing spring to cause the first engaging portion to disengage from the first positioning portion and the second engaging portion to disengage from a second positioning portion in order to pivot the tool head.

Since it is not easy to press the first and the second ratchet wheels against the biasing member to cause the first engaging portion to disengage from the first positioning portion and the second engaging portion to disengage from the second positioning portion at the same time. Likewise, it is not easy that the first engaging portion re-engages with the first positioning portion and the second engaging portion re-engages with the second positioning portion at the same time. In addition, if the first and the second ratchet wheels are not strong enough to withstand force transmissions during the operation of the hand tool, they are liable to get damaged easily.

The present invention is, therefore, intended to obviate or at least alleviate the problems encountered in the prior art.

SUMMARY OF THE INVENTION

According to the present invention, a flex-head tool includes a first portion and a second portion pivotally coupled to the first portion. The first portion has a first joining portion. The first joining portion defines a first pivot hole. The first pivot hole is toothed and has teeth. The second portion has second and third joining portions. The second and the third joining portions include the first joining portion disposed therebetween. The second joining portions defines a second pivot hole and the third joining portion defines a third pivot hole respectively. The second pivot hole is toothed and has teeth. A pivot mechanism is engaged with the first and the second portions and includes a shaft on which the first and the second portions turns. The shaft is inserted in the first, the second, and the third pivot holes. The shaft has a first engaging portion and a second engaging portion. The first engaging portion is toothed.

The pivot mechanism is movable between a first position in which the first portion is fixedly positioned with respect to the second portion, and a second position in which the first portion is pivotal with relative to the second portion. When the pivot mechanism is in the first position, the shaft is moved to a position in which the first engaging portion is engaged with the teeth of the first and the second pivot holes simultaneously and peripheries of the second engaging portion and the third pivot hole are connected with other and in surface-to-surface contact. When the pivot mechanism is in the second position, the shaft is moved to a position in which the first engaging portion is not engaged with the teeth of the first and the second pivot holes simultaneously and the peripheries of the second engaging portion and the third pivot hole are connected with other and in surface-to-surface contact.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
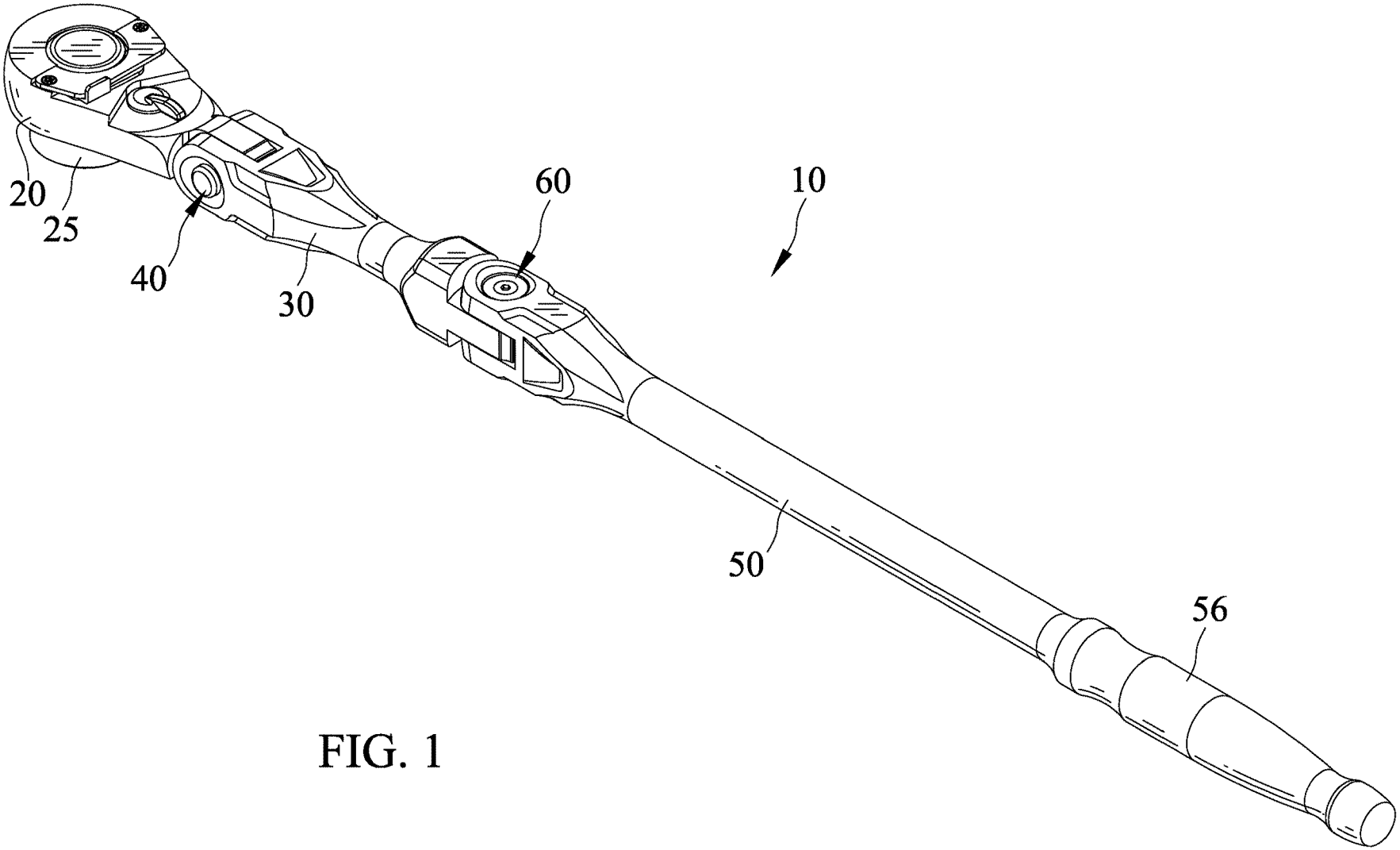
FIG. 1 is a perspective view of a flex-head tool in accordance with a first embodiment of the present invention.
Figure 2:
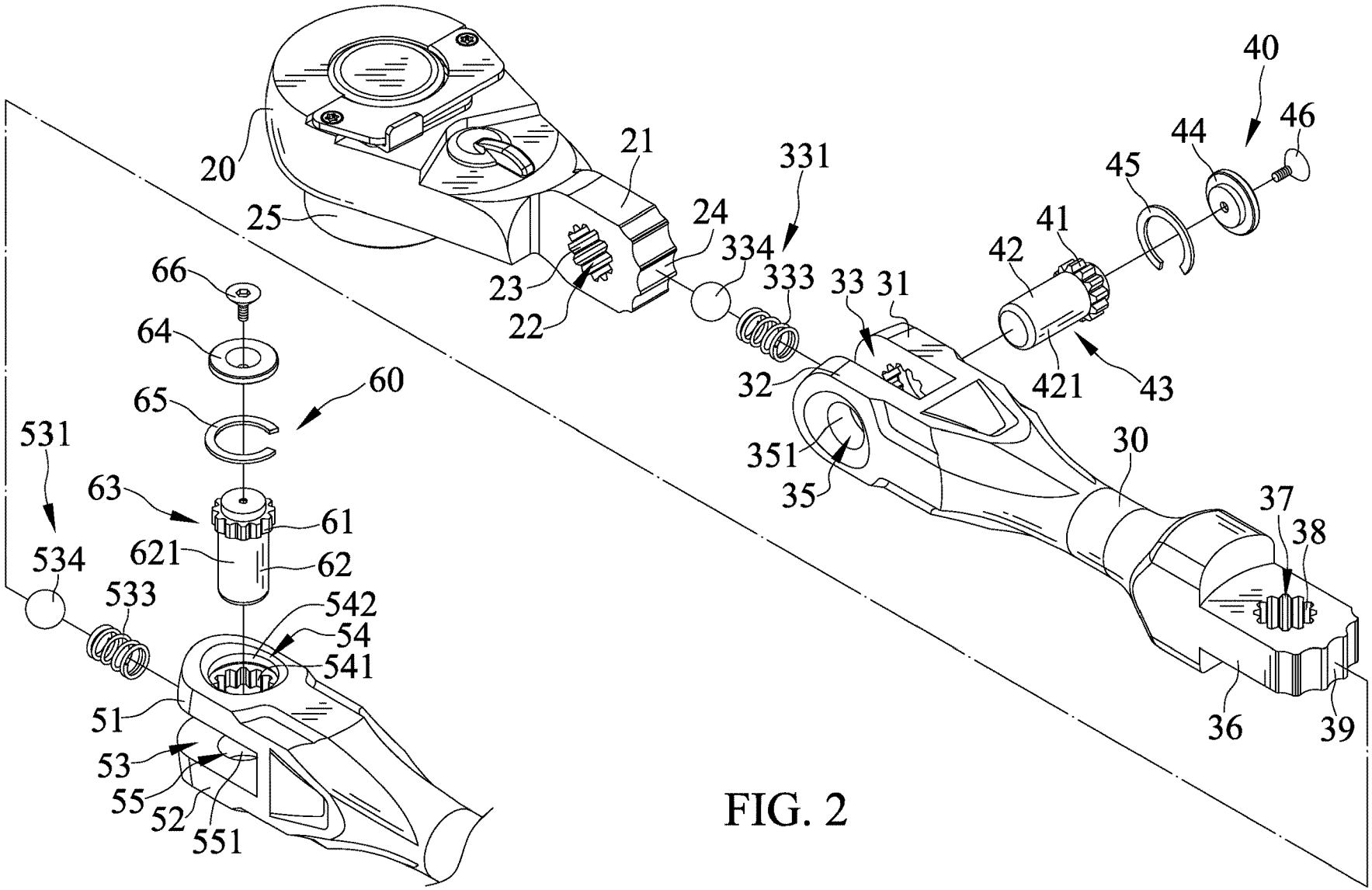
FIG. 2 is an exploded perspective view of the flex-head tool of FIG. 1.
Figure 3:
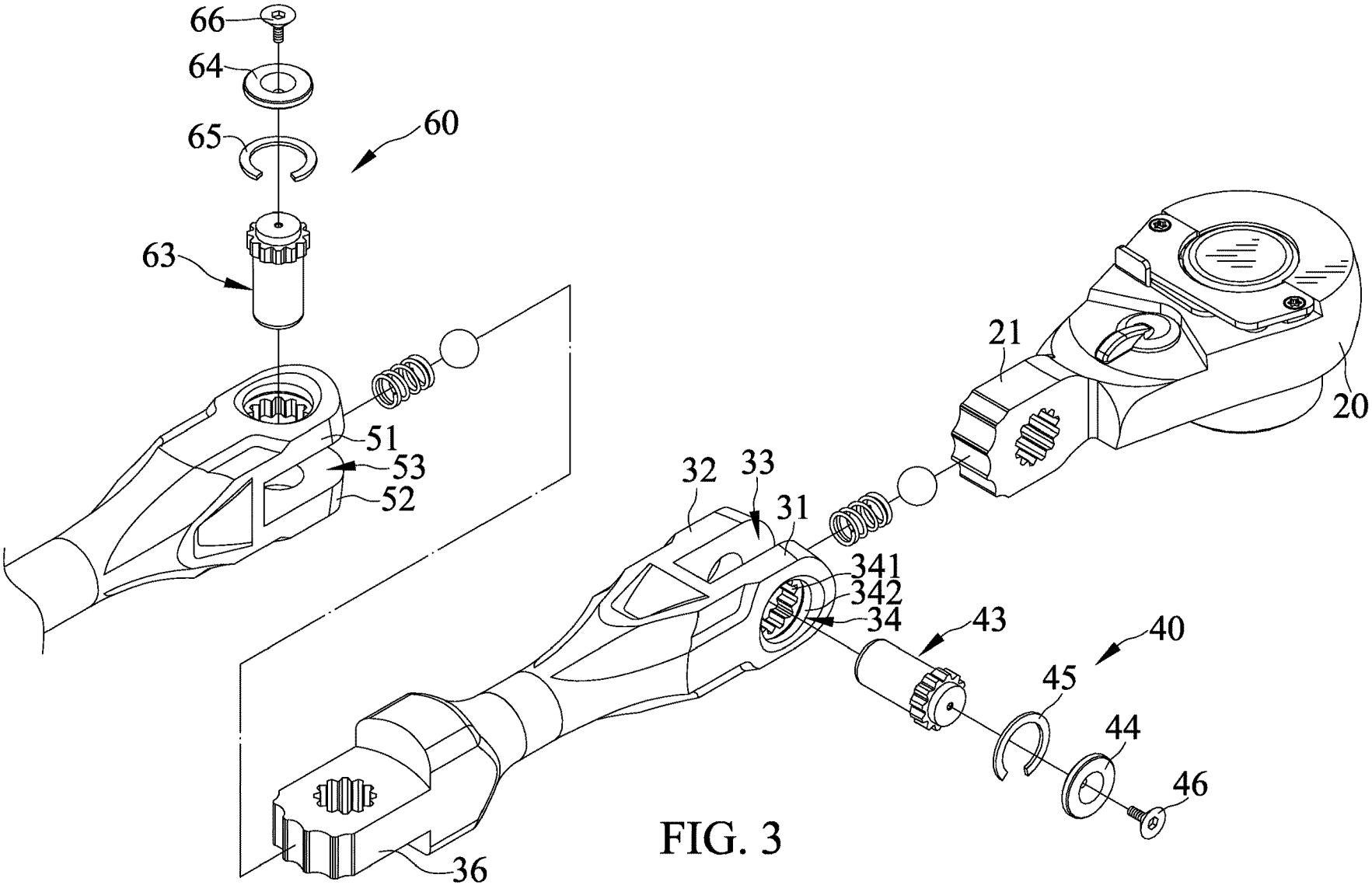
FIG. 3 is an exploded perspective view of the flex-head tool of FIG. 1, similar to FIG. 2, but taken from a different angle.
Figure 4:
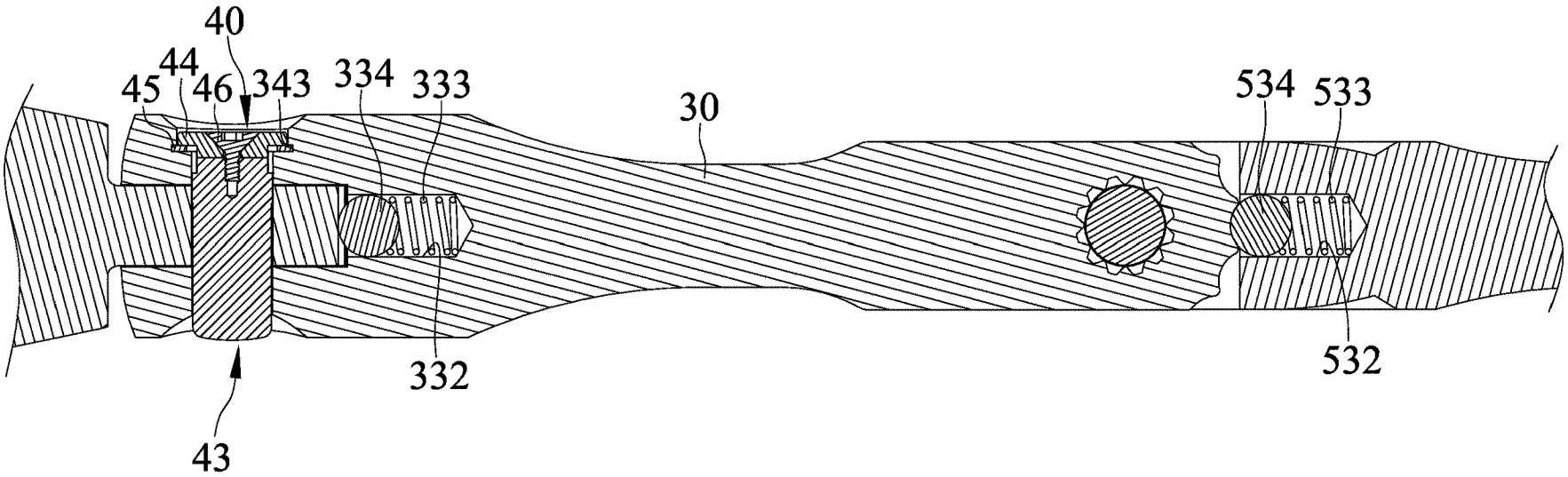
FIG. 4 is a cross-sectional view showing the flex-head tool of FIG. 1.
Figure 5:
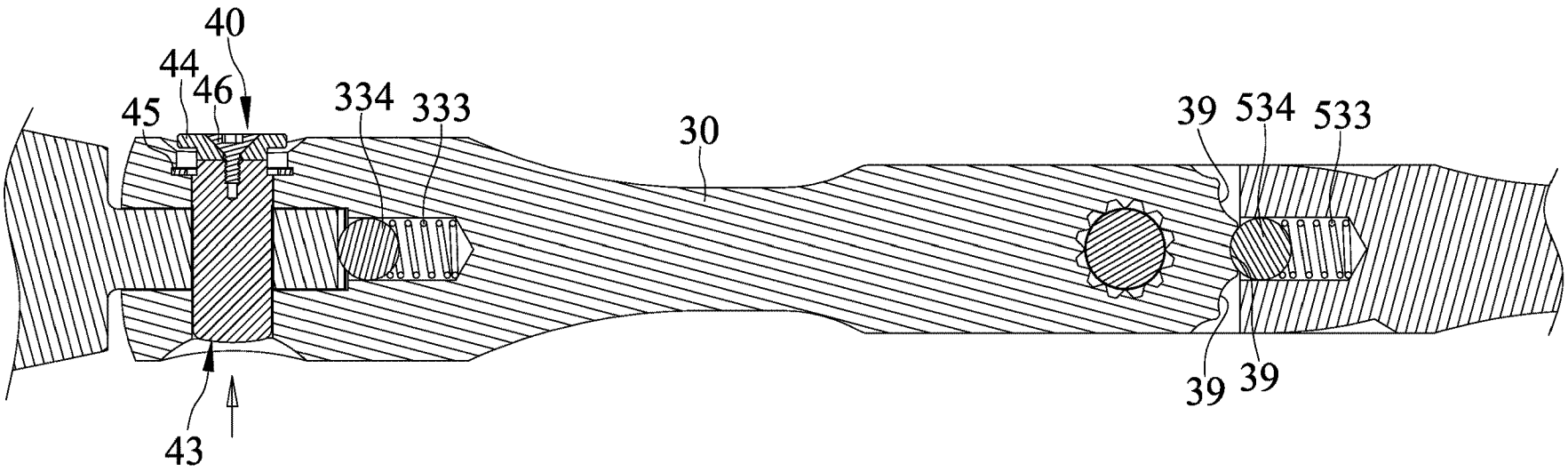
FIG. 5 is a cross-sectional view illustrating the operation of a first pivot mechanism of the flex-head tool of FIG. 1 moved from a locked position shown in FIG. 4 to an unlocked position.
Figure 6:
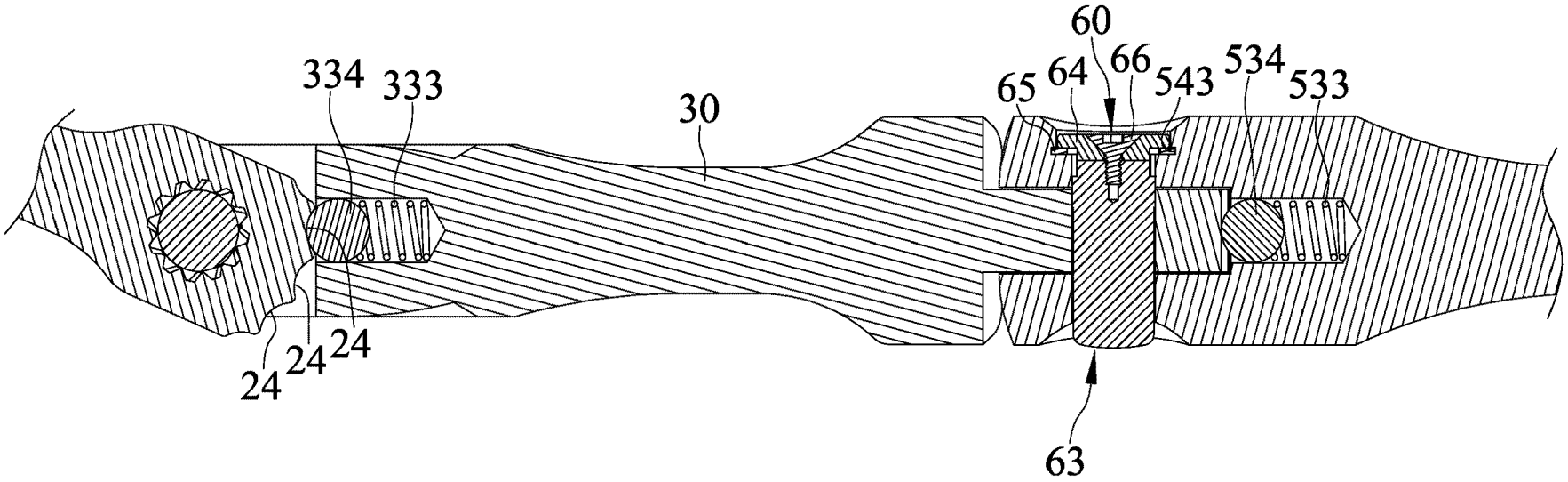
FIG. 6 is a cross-sectional view showing a first portion of the flex-head tool of FIG. 1 in a tilted position.
Figure 7:
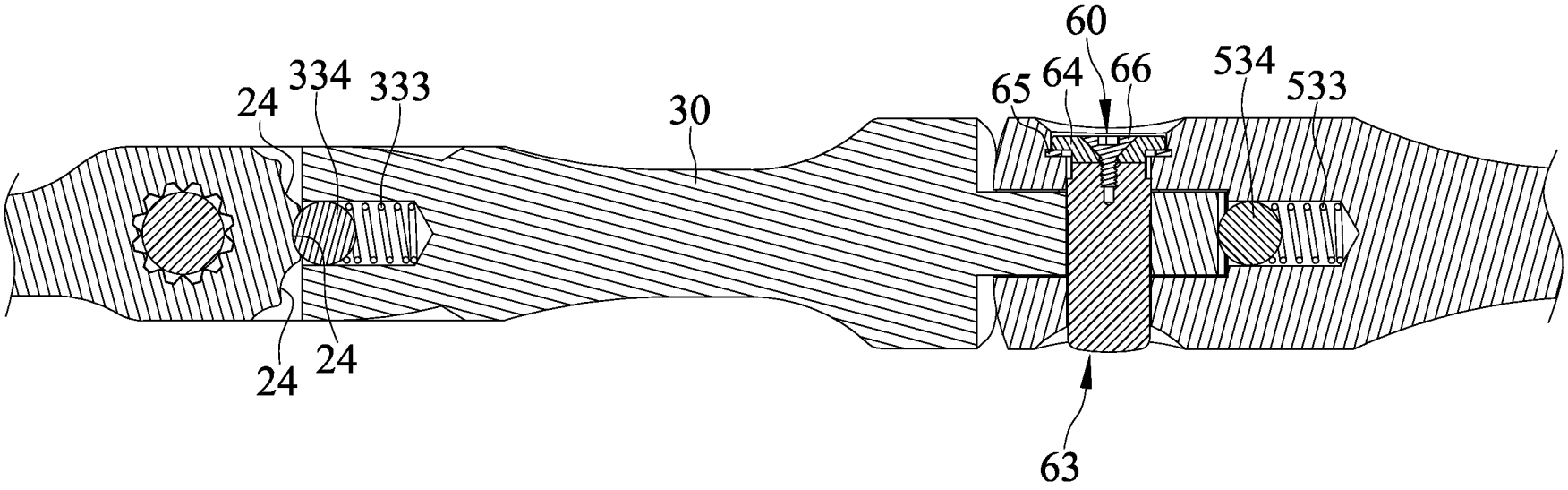
FIG. 7 is a cross-sectional view showing a second pivot mechanism of the flex-head tool of FIG. 1 in a locked position.

FIGS. 1 through 7 show a flex-head tool 10 in accordance with a first embodiment of the present invention. The flex-head tool 10 has a first portion 20, a second portion 30, and a third portion 50.

The first portion 20 has a joining portion 21 and a driving end 25. The joining portion 21 defines a pivot hole 22. The pivot hole 22 extends between opposite lateral sides of the joining portion 21 in a direction transverse to a longitudinal axis of the first portion 20. The pivot hole 22 extends through the joining portion 21. The pivot hole 22 is toothed and has teeth 23 disposed circumferentially on the inner periphery of the pivot hole 22. The joining portion 21 has a positioning end 24, which has a plurality of recesses. The positioning end 24 has an outer periphery, which is curved. The plurality of recesses are disposed one after another between distal ends of the curved outer periphery of the positioning end 24. The driving end 25 is in the form of a stub. The driving end 25 can engage with an object to be driven by the flex-head tool 10 directly or through a socket.

The second portion 30 has joining portions 31 and 32. The second portion 30 has a forked structure, which includes two prongs, which respectively define the joining portions 31 and 32. The joining portions 31 defines a pivot hole 34 and the joining portion 32 defines a pivot hole 35 respectively. The pivot hole 34 extends between opposite lateral sides of the joining portion 31 in a direction transverse to a longitudinal axis of the second portion 30. The pivot hole 34 extends through the joining portion 31. The pivot hole 35 extends between opposite lateral sides of the joining portion 32 in a direction transverse to a longitudinal axis of the second portion 30. The pivot hole 35 extends through the joining portion 32. The pivot hole 34 is toothed and has teeth 341 disposed circumferentially on the inner periphery of the pivot hole 34. The pivot hole 34 is adjacent to a compartment 342 and a slot 343. The slot 343 is disposed between the teeth 341 and the compartment 342. The slot 343 extends annularly. The inner periphery 351 of the pivot hole 35 is annular.

The second portion 30 has a joining portion 36. The joining portion 36 defines a pivot hole 37. The pivot hole 37 extends between opposite lateral sides of the joining portion 36 in a direction transverse to a longitudinal axis of the second portion 30. The pivot hole 37 extends through the joining portion 21. The pivot hole 37 is toothed and has teeth 38 disposed circumferentially on the inner periphery of the pivot hole 37. The joining portion 36 has a positioning end 39, which has a plurality of recesses. The positioning end 39 has an outer periphery, which is curved. The plurality of recesses are disposed one after another between distal ends of the curved outer periphery of the positioning end 39.

The first portion 20 is pivotally coupled to the second portion 30. The first portion 20 and the second portion 30 include a pivot mechanism 40 engaged therewith. The pivot mechanism 40 has a shaft 43 on which the first portion 20 and the second portion 30 turns. The shaft 43 is inserted in the pivot holes 22, 34 and 35. The shaft 43 has an engaging portion 41, which is toothed and has a plurality of teeth. The plurality of teeth of the engaging portion 41 are disposed circumferentially about the longitudinally axis of the shaft 43. The shaft 43 has a body 42, and the plurality of teeth of the engaging portion 41 protrudes radially from the body 42 about the longitudinal axis of the shaft 43. The shaft 43 has a flange 44, which has an outer periphery with a diameter greater than a diameter of the outer periphery of the shaft 43. The flange 44 and the shaft 43 are releasably fastened together by a fastener 46. The shaft 43 includes a resilient stop member 45 disposed thereon. The stop member 45 is disposed circumferentially on the shaft 43. The stop member 45 is disposed between the engaging portion 41 and the flange 44. The stop member 45 has an inside diameter less than the diameter of the outer periphery of the flange 44. Therefore, the flange 44 can obstruct the stop member 45. The stop member 45 is retained in the slot 343. The shaft 43 has an engaging portion 421 connected with the pivot hole 35.

The pivot mechanism 40 is movable between a first position in which the first portion 20 is fixedly positioned with respect to the second portion 30, and a second position in which the first portion 20 is pivotal with relative to the second portion 30. The first portion 20 is adapted to be fixedly positioned at various pivotal positions with respect to the second portion 30. When the pivot mechanism 40 is in the first position, the shaft 43 is moved to a position in which the engaging portion 41 is engaged with the teeth 23 and 341 simultaneously. Moreover, the outer periphery of the engaging portion 421 and the inner periphery 351 of the pivot hole 35 are connected with other and in surface-to-surface contact. The outer periphery of the engaging portion 421 is in a form of a circular column. In addition, the flange 44 is disposed in the compartment 342. When the pivot mechanism 40 is in the second position, the shaft 43 is moved to a position in which the engaging portion 41 is not engaged with the teeth 23 and 341 simultaneously. In the embodiment, the engaging portion 41 is disengaged from the teeth 23 and engaged with the teeth 341. Moreover, the outer periphery of the engaging portion 421 and the inner periphery 351 of the pivot hole 35 are connected with other and in surface-to-surface contact.

The first portion 20 and the second portion 30 include a positioning mechanism 33 engaged therewith. The positioning mechanism 33 has a retaining device 331, which includes a biasing spring 333 and a detent 334 urged by the biasing spring 333. The joining portions 31 and 32 are disposed in a spaced relationship and define a space 332 therebetween. The positioning mechanism 33 is retained in the space 332. The biasing spring 333 has one end abutting against the second portion 30 and another end abutting against the detent 334. When the portion 20 is fixedly positioned with respect to the portion 30, the detent 334 is retained in one of the plurality of recesses of the positioning end 24. Different relative pivotal positions of the first and the second portions 20 and 30 result in the detent 334 retained in different recesses of the positioning end 24.

The third portion 50 has joining portions 51 and 52. The third portion 50 has a forked structure, which includes two prongs, which respectively define the joining portions 51 and 52. The joining portion 51 is similar to the joining portions 31. Thus, the joining portions 51 defines a pivot hole 54 and the joining portion 52 defines a pivot hole 55 respectively. The pivot hole 54 extends between opposite lateral sides of the joining portion 51 in a direction transverse to a longitudinal axis of the third portion 50. The pivot hole 54 extends through the joining portion 31. The pivot hole 55 extends between opposite lateral sides of the joining portion 52 in a direction transverse to a longitudinal axis of the third portion 50. The pivot hole 55 extends through the joining portion 52. The pivot hole 54 is toothed and has teeth 541 disposed circumferentially on the inner periphery of the pivot hole 54. The pivot hole 54 is adjacent to a compartment 542 and a slot 543. The slot 543 is disposed between the teeth 541 and the compartment 542. The third portion 50 has an end forming a grip end 56, which is adapted to be held by a user of the flex-head tool 10.

The second portion 30 is pivotally coupled to the third portion 50. The second portion 30 and the third portion 50 include a pivot mechanism 60 engaged therewith. The pivot mechanism 60 is similar to the pivot mechanism 40. Thus, the pivot mechanism 60 has a shaft 63 on which the second portion 30 and the third portion 50 turns. The shafts 43 and 63 extends longitudinally in different directions. Further, the direction of the shaft 43 is transverse to the direction of the shaft 63. The shaft 63 has an engaging portion 61, which is toothed and has a plurality of teeth. The plurality of teeth of the engaging portion 61 are disposed circumferentially about the longitudinally axis of the shaft 63. The plurality of teeth of the engaging portion 61 protrudes radially from the body 62 about the longitudinal axis of the shaft 63. The shaft 63 has a flange 64, which has an outer periphery with a diameter greater than a diameter of the outer periphery of the body 62. The flange 64 and the body 62 are secured together by a fastener 66. The body 62 includes a resilient stop member 65 disposed thereon. The stop member 65 is disposed circumferentially on the body 62. The stop member 65 is disposed between the engaging portion 61 and the flange 64. The stop member 65 has an inside diameter less than the diameter of the outer periphery of the flange 64. Therefore, the flange 64 can obstruct the stop member 65. The shaft 63 has an engaging portion 621 connected with the pivot hole 55.

The pivot mechanism 60 is movable between a first position in which the second portion 30 is fixedly positioned with respect to the third portion 50, and a second position in which the second portion 30 is pivotal with relative to third portion 50. The second portion 30 is adapted to be fixedly positioned at various pivotal positions with respect to the third portion 50. When the pivot mechanism 60 is in the first position, the shaft 63 is moved to a position in which the engaging portion 61 is engaged with the teeth 38 and 541 simultaneously. Moreover, the outer periphery of the engaging portion 621 and the inner periphery 551 of the pivot hole 55 are connected with other and in surface-to-surface contact. In addition, the flange 64 is disposed in the compartment 542. When the pivot mechanism 40 is in the second position, the shaft 63 is moved to a position in which the engaging portion 61 is not engaged with the teeth 38 and 541 simultaneously. In the embodiment, the engaging portion 61 is disengaged from the teeth 38 and engaged with the teeth 541. Moreover, the outer periphery of the engaging portion 621 and the inner periphery 551 of the pivot hole 55 are connected with other and in surface-to-surface contact.

The second portion 30 and the third portion 50 include a positioning mechanism 53 engaged therewith. The positioning mechanism 53 is similar to the positioning mechanism 33. The positioning mechanism 53 has a retaining device 531, which includes a biasing spring 533 and a detent 534 urged by the biasing member 533. The joining portions 51 and 52 are disposed in a spaced relationship and define a space 532 therebetween. The positioning mechanism 53 is retained in the space 532.

Figure 8:
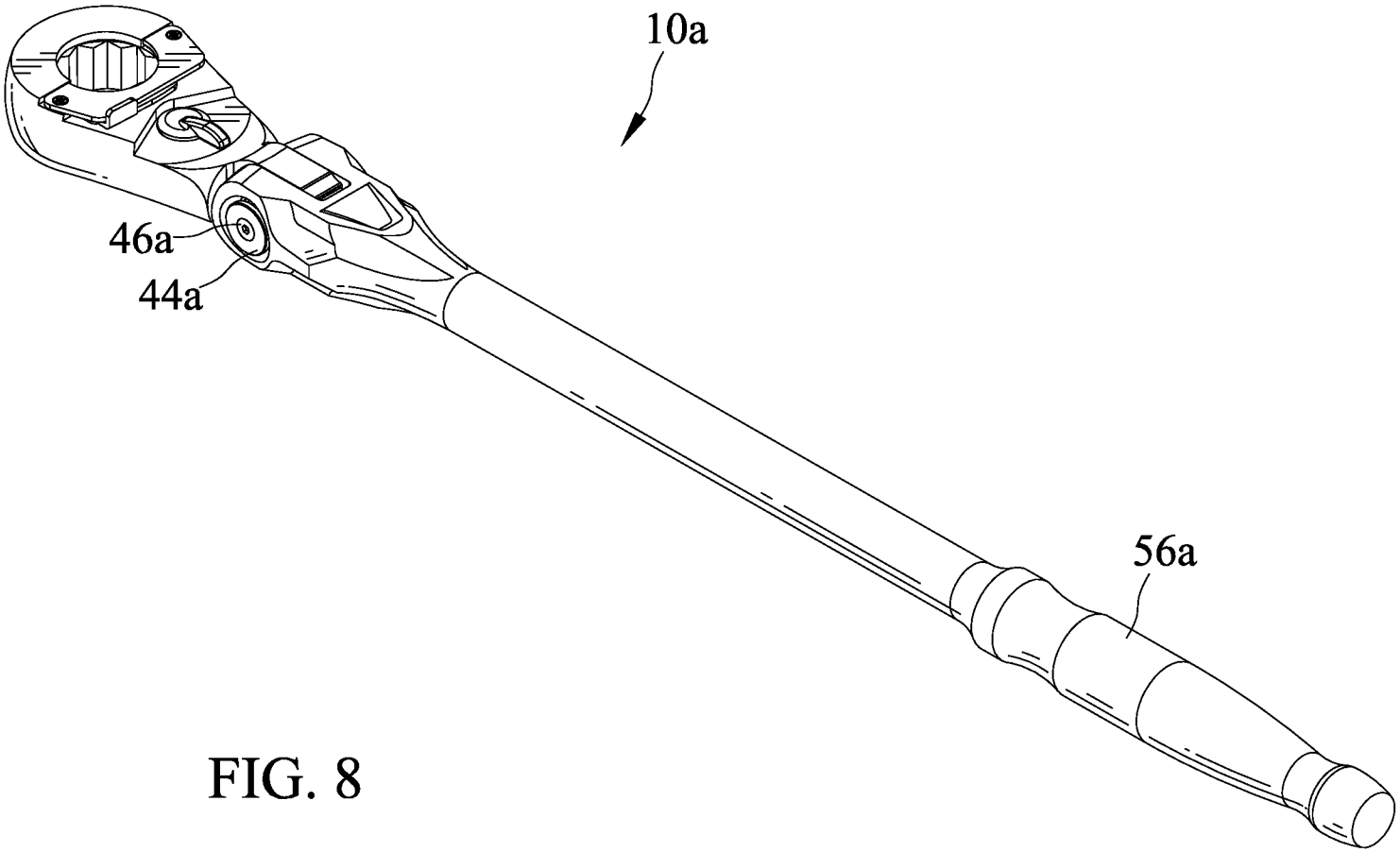
FIG. 8 is a perspective view of a flex-head tool in accordance with a second embodiment of the present invention.
Figure 9:
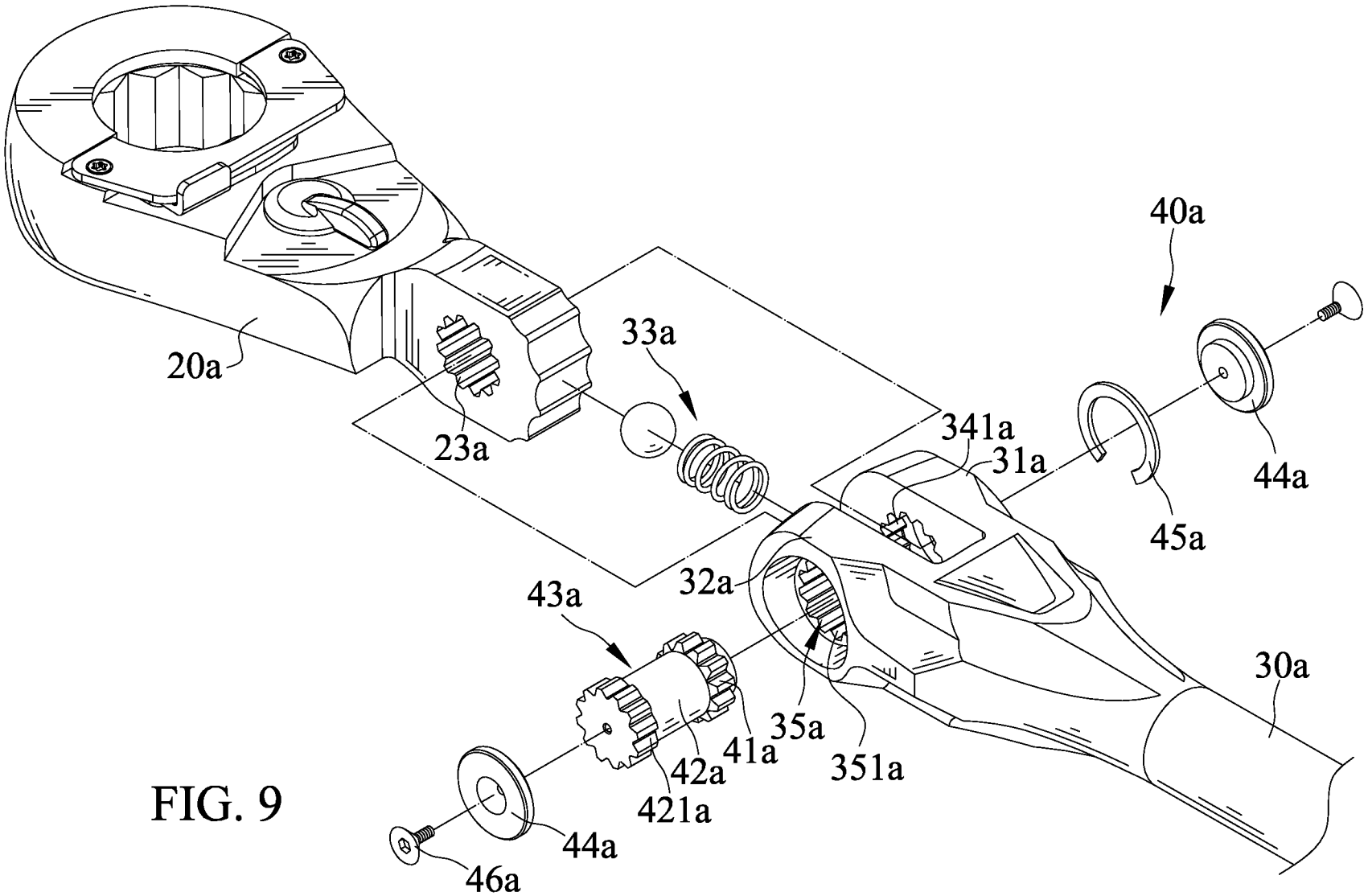
FIG. 9 is an exploded perspective view of the flex-head tool of FIG. 8.
Figure 10:
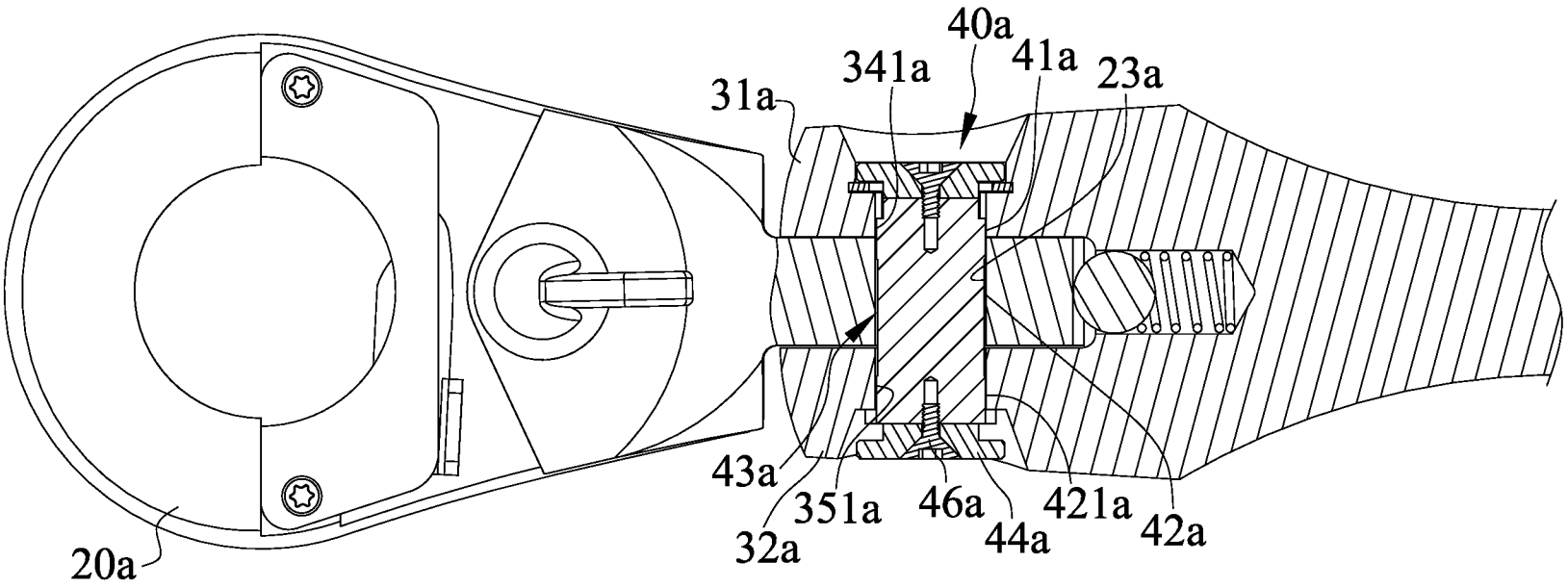
FIG. 10 is a cross-sectional view showing a pivot mechanism of the flex-head tool of FIG. 8.
Figure 11:
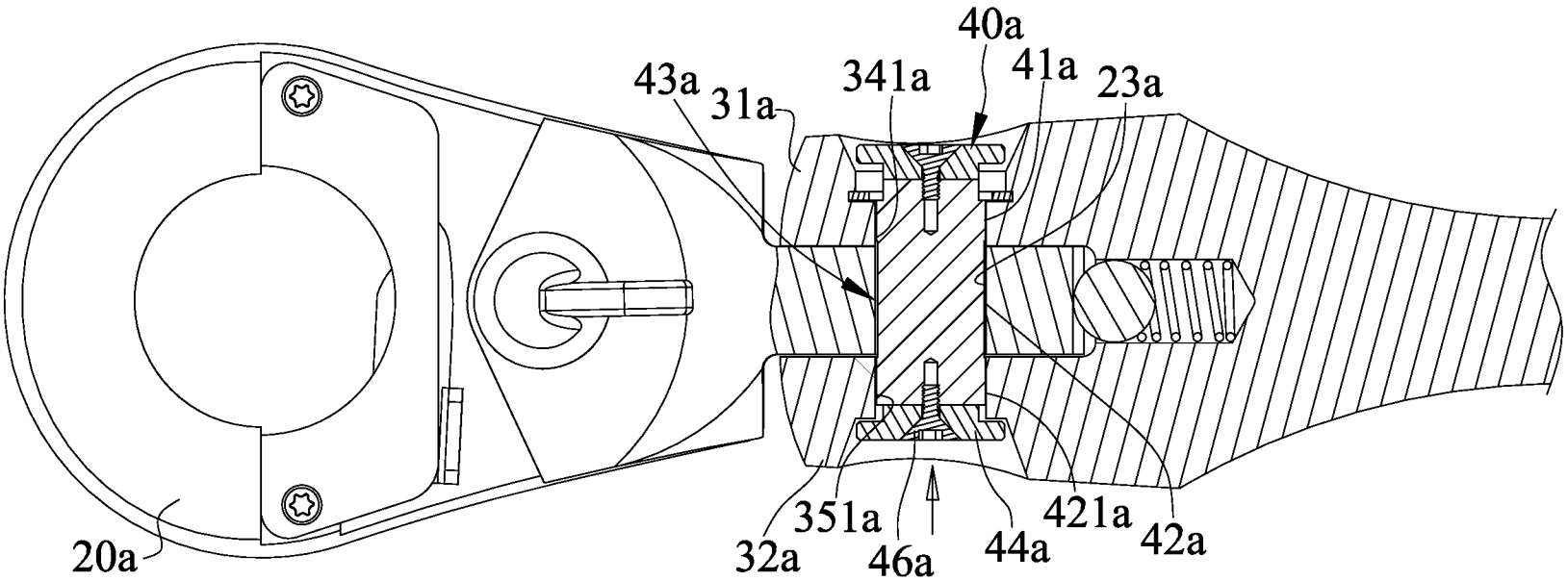
FIG. 11 is a cross-sectional view illustrating the operation of the pivot mechanism of the flex-head tool of FIG. 8 moved from a locked position shown in FIG. 10 to an unlocked position.

FIGS. 8 through 11 show a flex-head tool 10*a* in accordance with a second embodiment of the present invention, and the same numbers are used to correlate similar components of the first embodiment, but bearing a letter a. The flex-head tool 10*a* has a first portion 20*a* and a second portion 30*a*. The first portion 20*a* is the same as the first portion 20.

The second portion 30*a* has joining portions 31*a* and 32*a*. The joining portion 31*a* is similar to the joining portions 32*a*. The joining portion 31*a* is similar to the joining portion 31. Accordingly, the joining portion 32*a* differentiates from the joining portion 32. The joining portions 32*a* defines a pivot hole 35*a*. The pivot hole 35*a* extends between opposite lateral sides of the joining portion 32*a* in a direction transverse to a longitudinal axis of the second portion 30*a*. The pivot hole 35*a* extends through the joining portion 32*a*. The pivot hole 35*a* is toothed and has teeth disposed circumferentially on the inner periphery 351*a* of the pivot hole 35*a*. The inner periphery 351*a* of the pivot hole 35*a* is annular. The second portion 30*a* of the flex-head tool 10*a* has a forked structure, which includes two prongs, which respectively define the joining portions 31*a* and 32*a*.

The second portion 30*a* has an end forming a grip end 56*a*, which is adapted to be held by a user of the flex-head tool 10*a*.

The first portion 20*a* is pivotally coupled to the second portion 30*a*. The first portion 20*a* and the second portion 30*a* include a pivot mechanism 40*a* engaged therewith. The pivot mechanism 40*a* has a shaft 43*a* on which the first portion 20*a* and the second portion 30*a* turns. The shaft 43*a* has an engaging portion 41*a*, which is toothed and has a plurality of teeth. The plurality of teeth of the engaging portion 41*a* are disposed circumferentially about the longitudinally axis of the shaft 43*a*. The shaft 43*a* has a body 42*a*, and the plurality of teeth of the engaging portion 41*a* protrudes radially from the body 42*a* about the longitudinal axis of the shaft 43*a*. The first portion 20*a* is pivotal with respect to the second portion 30*a* in a first direction corresponding to a longitudinal axis of the shaft 43*a*. The pivot mechanism 40*a* is similar to the pivot mechanism 40 except that an engaging portion 421*a*, which is connected with the pivot hole 35*a*, is toothed and has a plurality of teeth. The plurality of teeth of the engaging portion 421*a* are disposed circumferentially about the longitudinally axis of the shaft 43*a*. The shaft 43*a* has two flanges 44*a*. One of the two flanges 44*a* is adjacent to a first end of the shaft 43*a*. The other of the two flanges 44*a* is adjacent to a second end of the shaft 43*a*. Each of the two flanges 44*a* and the shaft 43 are secured together by a fastener 46*a*. A resilient stop member 45*a* is disposed circumferentially on the shaft 43*a*. The stop member 45*a* is disposed between the engaging portion 41*a* and the flange 44*a* that are adjacent to the first end of the shaft 43*a*.

The pivot mechanism 40*a* is movable between a first position in which the first portion 20*a* is fixedly positioned with respect to the second portion 30*a*, and a second position in which the first portion 20*a* is pivotal with relative to the second portion 30*a*. The first portion 20*a* is adapted to be fixedly positioned at various pivotal positions with respect to the second portion 30*a*. When the pivot mechanism 40*a* is in the first position, the shaft 43*a* is moved to a position in which one of the engaging portion 41*a* is engaged with teeth 23*a* and 341*a* simultaneously. Moreover, the engaging portions 421*a* is connected with the pivot hole 35*a* and in surface-to-surface contact. The outer periphery of the engaging portions 421*a*, which is connected with the inner periphery of the pivot hole 35*a*, is in a form of a non-circular column. Thus, flex-head tool 10*a* can withstand greater force transmissions than the flex-head tool 10. In addition, the flange 44 is disposed in the compartment 342. When the pivot mechanism 40*a* is in the second position, the shaft 43*a* is moved to a position in which the engaging portion 41*a* is not engaged with the teeth 23*a* and 341*a* simultaneously. In the embodiment, the engaging portion 41*a* is disengaged from the teeth 23 and engaged with the teeth 341*a*. Moreover, the engaging portions 421*a* is engaged with the pivot hole 35*a* and in surface-to-surface contact. Thus, the shaft 43*a* is prevented from rotation when the first portion 20*a* pivots with relative to the second portion 30*a*.

The first portion 20*a* and the second portion 30*a* include a positioning mechanism 33*a* engaged therewith. The positioning mechanism 33*a* is similar to the positioning mechanism 33.

In view of the foregoing, the pivot mechanisms 40 and 60 allow the flex-head tool 10 to be used in a restricted working space. The flex-head tool 10 can withstand force transmissions than convention flex-head tools because the outer periphery of the engaging portion 421 and the inner periphery 351 of the pivot hole 35 are connected with other and in surface-to-surface contact. Likewise, the flex-head tool 10*a* can withstand force transmissions because the engaging portions 421*a* is engaged with the engaging portion of the pivot hole 35*a* and in surface-to-surface contact.

The foregoing is merely illustrative of the principles of this invention and various modifications can be made by those skilled in the art without departing from the scope and spirit of the invention.

What is claimed is:

1. A flex-head tool comprising:

a first portion having a first joining portion, wherein the first joining portion defines a first pivot hole, and wherein the first pivot hole is toothed and has teeth;

a second portion pivotally coupled to the first portion and having second and third joining portions, wherein the second and the third joining portions include the first joining portion disposed therebetween, wherein the second joining portion defines a second pivot hole and the third joining portion defines a third pivot hole respectively, wherein the second pivot hole is toothed and has teeth; and a pivot mechanism engaged with the first and the second portions and including a shaft on which the first and the second portions turns, wherein the shaft is inserted in the first, the second, and the third pivot holes, wherein the shaft has a first engaging portion and a second engaging portion, and wherein the first engaging portion is toothed, wherein the pivot mechanism is movable between a first position in which the first portion is fixedly positioned with respect to the second portion, and a second position in which the first portion is pivotal with relative to the second portion, wherein when the pivot mechanism is in the first position, the shaft is moved to a position in which the first engaging portion is engaged with the teeth of the first and the second pivot holes simultaneously and peripheries of the second engaging portion and the third pivot hole are connected with other and in surface-to-surface contact, and wherein when the pivot mechanism is in the second position, the shaft is moved to a position in which the first engaging portion is not engaged with the teeth of the first and the second pivot holes simultaneously and the second engaging portion and the third pivot hole are connected with other and in surface-to-surface contact, wherein the second pivot hole is adjacent to a slot, wherein the shaft includes a stop member disposed thereon, and wherein stop member is retained in the slot, and wherein the second pivot hole is adjacent to a compartment, wherein the slot is disposed between the teeth of the second pivot hole and the compartment, wherein the shaft has a flange adapted to obstruct the stop member, and wherein the flange is disposed in the compartment.

2. The flex-head tool as claimed in claim 1, wherein the periphery of the second engaging portion is in a form of a circular column.

3. The flex-head tool as claimed in claim 1, wherein the first portion and the second portion include a positioning mechanism engaged therewith, wherein the positioning mechanism includes a biasing spring and a detent urged by the biasing spring, wherein the first joining portion has a positioning end, which has a plurality of recesses, and wherein when the first portion is fixedly positioned with respect to the second portion, the detent is retained in one of the plurality of recesses of the positioning end.

4. The flex-head tool as claimed in claim 3, wherein the second and third joining portions define a space therebetween, and the positioning mechanism is retained in the space.

5. The flex-head tool as claimed in claim 1, wherein the slot extends annularly, and wherein the stop member is disposed circumferentially on the shaft.

6. The flex-head tool as claimed in claim 5, wherein the stop member is resilient.

7. The flex-head tool as claimed in claim 1, wherein the second portion has an end forming a grip end, which is adapted to be held by a user of the flex-head tool.

8. The flex-head tool as claimed in claim 1, wherein the flange and the shaft are releasably fastened together by a fastener.

9. The flex-head tool as claimed in claim 1, wherein the shaft has two flanges, and wherein one of the two flanges is adjacent to a first end of the shaft and the other of the two flanges is adjacent to a second end of the shaft.

10. A flex-head tool comprising:

a first portion having a first joining portion, wherein the first joining portion defines a first pivot hole, and wherein the first pivot hole is toothed and has teeth;

a second portion pivotally coupled to the first portion and having second and third joining portions, wherein the second and the third joining portions include the first joining portion disposed therebetween, wherein the second joining portion defines a second pivot hole and the third joining portion defines a third pivot hole respectively, wherein the second pivot hole is toothed and has teeth; and a pivot mechanism engaged with the first and the second portions and including a shaft on which the first and the second portions turns, wherein the shaft is inserted in the first, the second, and the third pivot holes, wherein the shaft has a first engaging portion and a second engaging portion, and wherein the first engaging portion is toothed; and a third portion pivotally coupled to the second portion, and wherein the second and the third portions include a second pivot mechanism engaged therewith, wherein the second pivot mechanism includes a shaft on which the second and the third portions turns, wherein the pivot mechanism is movable between a first position in which the first portion is fixedly positioned with respect to the second portion, and a second position in which the first portion is pivotal with relative to the second portion, wherein when the pivot mechanism is in the first position, the shaft is moved to a position in which the first engaging portion is engaged with the teeth of the first and the second pivot holes simultaneously and peripheries of the second engaging portion and the third pivot hole are connected with other and in surface-to-surface contact, and wherein when the pivot mechanism is in the second position, the shaft is moved to a position in which the first engaging portion is not engaged with the teeth of the first and the second pivot holes simultaneously and the second engaging portion and the third pivot hole are connected with other and in surface-to-surface contact, wherein the second pivot hole is adjacent to a slot, wherein the shaft includes a stop member disposed thereon, and wherein stop member is retained in the slot, and wherein the second pivot hole is adjacent to a compartment, wherein the slot is disposed between the teeth of the second pivot hole and the compartment, wherein the shaft has a flange adapted to obstruct the stop member, and wherein the flange is disposed in the compartment.

11. The flex-head tool as claimed in claim 10, wherein the periphery of the second engaging portion is in a form of a non-circular column.

12. The flex-head tool as claimed in claim 11, wherein the periphery of the second engaging portion is toothed.

13. The flex-head tool as claimed in claim 10, wherein the second portion has a fourth joining portion, wherein the fourth joining portion defines a fourth pivot hole, wherein the fourth pivot hole is toothed and has teeth, wherein the third portion has fifth and sixth joining portions, wherein the fifth and sixth joining portions include the fourth joining portion disposed therebetween, wherein the fifth joining portion defines a fifth pivot hole and the sixth joining portion defines a sixth pivot hole respectively, wherein the fifth pivot hole is toothed and has teeth, wherein the shaft of the second pivot mechanism has a third engaging portion and a fourth engaging portion, wherein the third engaging portion is toothed, wherein the second pivot mechanism is movable between a first position in which the second portion is fixedly positioned with respect to the third portion, and a second position in which the second portion is pivotal with relative to the third portion, wherein when the second pivot mechanism is in the first position, the shaft of the second pivot mechanism is moved to a position in which the third engaging portion is engaged with the teeth of the fourth and the fifth pivot holes simultaneously and peripheries of the fourth engaging portion and the sixth pivot hole are connected with other and in surface-to-surface contact, and wherein when the second pivot mechanism is in the second position, the shaft is moved to a position in which the third engaging portion is not engaged with the teeth of the fourth and the fifth pivot holes simultaneously and peripheries of the fourth engaging portion and the sixth pivot hole are connected with other and in surface-to-surface contact.

14. The flex-head tool as claimed in claim 13, wherein the second portion and the third portion include a second positioning mechanism engaged therewith, wherein the second positioning mechanism includes a biasing spring and a detent urged by the biasing spring, wherein the fourth joining portion has a positioning end, which has a plurality of recesses, and wherein when the second portion is fixedly positioned with respect to the third portion, the detent is retained in one of the plurality of recesses of the positioning end of the fourth joining portion.

15. The flex-head tool as claimed in claim 14, wherein the fifth and sixth joining portions define a space therebetween, and the second positioning mechanism is retained in the space.

16. The flex-head tool as claimed in claim 10, wherein the third portion has an end forming a grip end, which is adapted to be held by a user of the flex-head tool, and wherein the first portion has a driving end adapted to engage with an object to be driven.

17. The flex-head tool as claimed in claim 10, wherein the shaft of the second pivot mechanism and the shaft of the pivot mechanism extends longitudinally in different directions.

* * * * *